United States Patent [19]

Karlen

[11] 4,140,251

[45] Feb. 20, 1979

[54] DECANTER HAVING SET-IN-PLACE SEALING MEANS

[75] Inventor: Harvey R. Karlen, Chicago, Ill.

[73] Assignee: Cory Food Services, Inc., Chicago, Ill.

[21] Appl. No.: 803,345

[22] Filed: Jun. 3, 1977

[51] Int. Cl.[2] ..... A47G 19/14

[52] U.S. Cl. ..... 222/465; 222/542

[58] Field of Search ..... 222/465, 542, 475; 215/100 R, 100 A, DIG. 6, 352; 220/85 R, 85 SP, 378

[56] References Cited

U.S. PATENT DOCUMENTS

| | | | |
|---|---|---|---|
| 1,446,474 | 2/1923 | Mahnken | 215/226 |
| 2,049,219 | 7/1936 | Muschinske et al. | 222/465 |
| 2,376,909 | 5/1945 | Ford | 215/352 X |
| 2,920,778 | 1/1960 | Foye | 215/353 |
| 3,114,484 | 12/1963 | Serio | 222/465 |
| 3,688,936 | 9/1972 | Killigrew | 215/100 A |
| 3,717,288 | 2/1973 | Schlegel | 222/465 |
| 3,800,988 | 4/1974 | Karlen et al. | 222/465 |

*Primary Examiner*—Stanley H. Tollberg
*Assistant Examiner*—Francis J. Bartuska
*Attorney, Agent, or Firm*—Wegner, Stellman, McCord, Wiles & Wood

[57] ABSTRACT

A decanter for use with a beverage, such as coffee, having a pouring spout provided with a mounting portion carrying a suitable handle. The mounting structure is sealingly secured to the neck of the decanter by compressive engagement with a seal ring set in place about the neck of the decanter below the upper edge thereof. The seal ring is compressed both axially and radially as a result of the engagement therewith by a stepped portion of the bore of the mounting structure. The mounting structure is retained against axial displacement from the installed condition wherein the seal is thusly compressed by an interlock at the lower end of the mounting structure and a cooperating portion on the decanter neck. An upper, inturned flange on the mounting structure is spaced slightly above the upper edge of the decanter neck in the installed arrangement of the spout on the decanter.

7 Claims, 3 Drawing Figures

DECANTER HAVING SET-IN-PLACE SEALING MEANS

BACKGROUND OF THE INVENTION

1. Field of the Invention

This invention relates to decanters and in particular to decanters such as for use in handling and serving beverages and the like.

2. Description of the Prior Art

In U.S. Pat. No. 3,717,288 of Norman H. Schlegel, owned by the assignee hereof, a decanter handle structure is disclosed having a handle connected to the neck of the decanter by a split collar and a protective band extending about the globular portion of the decanter bowl. The handle structure comprises a one-piece device formed of suitable molded plastic.

In U. S. Pat. No. 3,800,988 of Harvey R. Karlen et al, owned by the assignee hereof, a one-piece spout and handle structure is shown wherein the handle is secured to the neck of the decanter by an annular connector portion having an integral spout portion extending outwardly from the top of the neck. The connecting portion is sealed to the glass neck by an O-ring and the handle structure is secured to the glass decanter bowl by an inturned rib drawn into an annular recess on the decanter neck by suitable threaded or riveted means.

A multiple element handle and pouring spout assembly is shown in U.S. Pat. No. 3,144,484 of Anthony W. Serio. In the Serio assembly, a rubber seal is compressed within the attaching portion of the handle assembly to seal the assembly to the glass decanter neck.

Daniel L. Killigrew, Jr., in U.S. Pat. No. 3,688,936, shows a decanter assembly wherein the glass bowl is provided with a peripheral groove receiving a resilient band attached to the lower portion of the handle.

William R. Mahnken, in U.S. Pat. No. 1,446,474, shows a bottle appliance wherein means for closing the top of the bottle are mounted to the handle which is connected to the bottle by a pair of connecting bands.

In U.S. Pat. No. 2,049,219 of John J. Muschinske et al, a bottle attachment is shown wherein a spout portion formed of plastic or deformable material is stretched over the rim of the bottle. The handle comprises a wire means which includes a ring clamped about the spout to rigidly secure the handle and spout to the bottle.

In my copending application for U.S. Pat. Ser. No. 727,256, filed Sept. 27, 1976 now abandoned, and entitled "Decanter Having Set-In-Place Sealing Means", a spout is provided with a mounting portion wherein an inturned upper flange abuts the upper edge of the decanter neck in the installed arrangement of the spout. The set-in-place annular seal is received in an inwardly facing rounded shoulder portion of the mounting structure. A lower interlock means is provided for retaining the spout with the upper inturned flange abutting the upper edge of the neck and with the seal effectively compressed solely in a radial direction.

SUMMARY OF THE INVENTION

The present invention comprehends an improved decanter structure having a glass bowl provided with an upstanding tubular neck terminating in an upper edge, a pouring spout, annular mounting means for mounting the pouring spout on the neck, means having a first portion on the neck spaced below the upper edge, and a second portion on the annular mounting means for interlocking the pouring spout removably to the neck, and a handle connected to the annular mounting means. More specifically, the improvement comprises means defining an annular set-in-place resilient seal extending about the neck intermediate the upper edge and the first portion of the interlocking means, the seal being formed of an adhesive material preselected to be effectively positively sealingly bonded to the neck as a result of setting thereof in place on the neck, the mounting means being removably installed about the set annular seal and maintained in radially and axially compressed sealed engagement therewith by the interlock means.

The mounting means may include an annular downwardly facing shoulder engaging the seal in the installed relationship thereof to effect the axial compression of the seal.

The mounting means may further define an upper, radially inwardly projecting shoulder disposed adjacent the upper edge of the neck.

In the illustrated embodiment, the upper shoulder is spaced slightly above the upper edge of the neck.

More specifically in the illustrated embodiment, the mounting means defines a stepped bore having an upper portion and a lower portion, the upper portion having a smaller diameter than that of said lower portion to define and annular shoulder therebetween, the seal having a first, lower portion compressed radially in the lower portion of the mounting means with a first compressive sealing force and a second, upper portion compressed radially in the upper portion of the mounting means with a second higher compressive sealing force.

The upper inturned shoulder, while normally being spaced slightly above the upper edge of the neck, effectively defines a means for positively limiting the downward movement of the mounting means about the decanter neck so as to effectively positively limit the downward urging of the seal by the shoulder between the lower upper bore portions, thereby effectively precluding excessive stress on the seal tending to break the adhesive bond thereof to the decanter neck.

In the illustrated embodiment, the outer surface of the seal is semicircular.

In one highly advantageous form, the seal was formed of RTV silicone adhesive.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
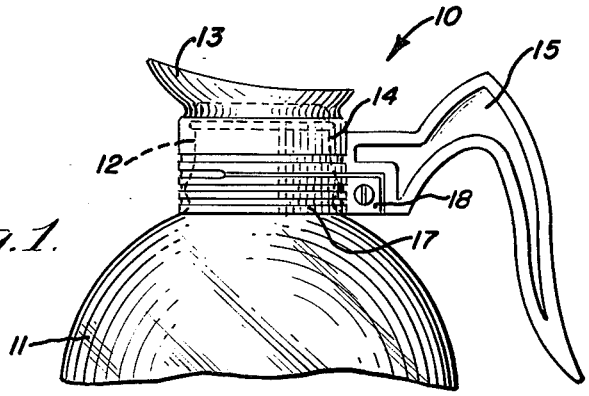
FIG. 1 is a fragmentary side elevation of a decanter having improved sealing means embodying the invention.

In the exemplary embodiment of the invention as disclosed in the drawing, a decanter structure generally designated 10 is shown to comprise a glass decanter bowl 11 having an upstanding neck 12. A pouring spout 13 is secured to the neck by a suitable mounting means 14 provided with a suitable carrying handle 15.

Neck 12 may be provided with an annular reentrant portion 16 receiving an annular inturned flange portion 17 defining a lower edge portion of the connecting means 14. The inturned flange 17 may be retained in the embracing relationship illustrated in FIGS. 1 and 3 by a suitable locking screw 18.

Figure 2:
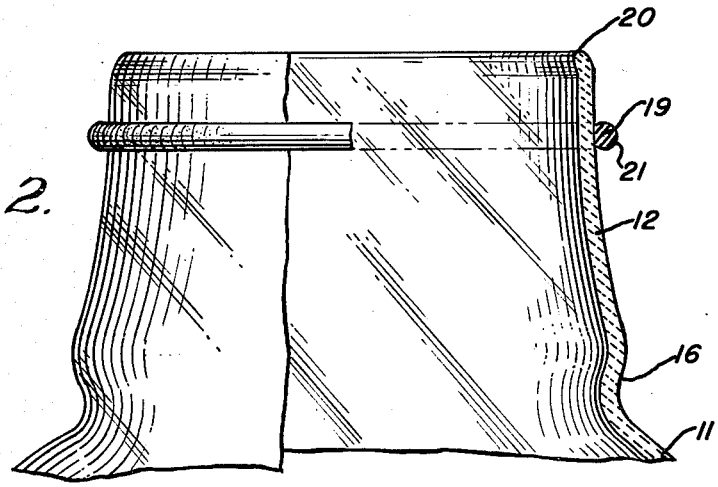
FIG. 2 is a fragmentary enlarged elevation with a portion broken away illustrating the provision of the set-in-place seal on the decanter neck.
Figure 3:
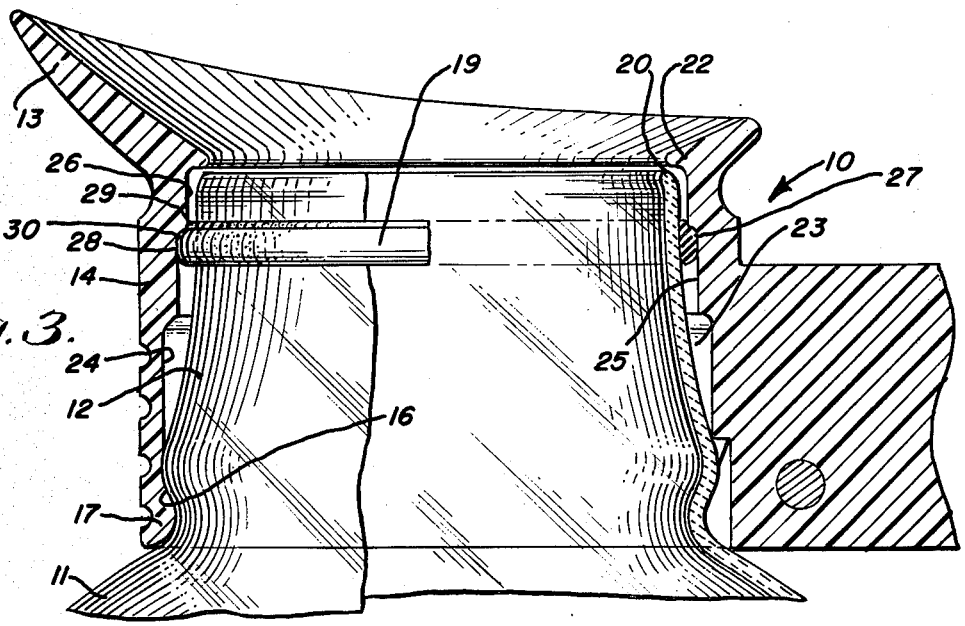
FIG. 3 is a fragmentary enlarged side elevation with portions broken away and portions shown in diametric section illustrating the arrangement of the decanter structure in the assembled condition.

As seen in FIG. 3, the engagement of the interlock portion 17 with the neck in the recess 16 effectively prevents axial outward movement of the mounting portion 14 relative to the neck and thusly effectively retains the spout 13 in place on the decanter. The present invention is concerned with the sealing of the spout, and more particularly the mounting portion 14, to the decanter neck. Thus, as shown in FIG. 2, the decanter neck is provided with a set-in-place annular seal 19 which encircles the neck below the upper edge 20 and above the reentrant portion 16. In the illustrated embodiment, the seal is formed of an adhesive, such as RTV silicone adhesive adapted to be effectively positively bonded to the glass neck 12 under a wide range of temperatures as to which the decanter may be subjected in the normal use thereof. As shown in FIG. 2, the outer surface 21 of the seal may be substantially semicircular in the undeformed, set-in-place condition.

As shown in FIG. 3, the mounting portion 14 of the spout is provided with an upper, annular inturned flange 22 defining a shoulder overlying the neck upper edge 20 in the installed arrangement. Upwardly of the inturned lower portion 17, the mounting means 14 defines a stepped bore 23 having a lowermost portion 24 extending upwardly from the inturned lower edge 17. The upper portion of the bore is arranged to receive the seal 19 and is defined by a lower portion 25 and an upper portion 26 defining a rounded shoulder 27 therebetween.

The spacing of shoulder 27 above the inturned portion 17 is accurately correlated with the spacing of the reentrant portion 16 of the decanter neck and the location of the seal 19 so that, as shown in FIG. 3, when the spout structure is mounted to the decanter neck, the shoulder 27 is urged forcibly against the seal 19 so as to cause the formation of a three-part seal of the spout connecting means to the decanter neck. More specifically, the lower portion 25 of the bore has a diameter less than the undeformed outer diameter of the seal 19 so that the portion of the seal received therein, as shown in FIG. 3, is radially compressed to provide a first seal with the spout mounting means. As shown in FIG. 3, this first seal portion 28 is flattened somewhat from the rounded outer configuration 21 shown in FIG. 2 so as to provide a substantial facial surface seal with the spout mounting means.

The upper portion 29 of the seal is received within the small bore portion 26 and, thus, is compressed substantially more than the portion 28 so as to define a second seal between the decanter neck and the mounting portion 14 of the spout. Intermediate the seal portions 28 and 29, the seal defines an inwardly rounded portion 30 abutting the shoulder 27. The force generated by the mounting means against the surface 30 tends to urge the seal longitudinally relative to the decanter neck, and the present invention comprehends the provision of the seal of suitable material so as to positively bond the seal to the decanter neck so as to avoid any movement of the seal along the glass surface notwithstanding the application of the longitudinal force thereto. It has been found that forming the seal of an adhesive material such as RTV silicone adhesive material provides the necessary bonding strength. As will be obvious to those skilled in the art, other suitable materials having suitable bonding and resilient characteristics may be utilized within the scope of the invention.

The disposition of the interlock portion 16 of the decanter neck and the location of the seal 19 thereon is preselected in coordination with the spacing of the mounting means portion 17 and the shoulder 27 so as to effect the desired double seal action discussed above. The spacing of the flange portion 22 from the interlock portion 17 is also preselected so as to cause the flange portion 22 to be closely adjacent the upper edge 30 of the decanter neck and minimize leakage therebetween, as shown in FIG. 3.

Thus, the present invention permits the decanter neck to have a relatively wide dimensional tolerance in both its length and radial dimensions while yet assuring a positive sealed connection of the spout thereto in a novel and simple manner. Illustratively, it has been conventional to provide such glass decanter necks having a diametrical variation of ±0.045" and similar corresponding longitudinal variations. The present invention, by permitting the use such relatively low cost, high tolerance decanter structures, provides a substantial improvement in the decanter art.

The foregoing disclosure of specific embodiments is illustrative of the broad inventive concepts comprehended by the invention.

I claim:

1. In a decanter structure having a glass bowl provided with an upstanding tubular neck terminating in an upper edge, a pouring spout, annular mounting means on said pouring spout for mounting said pouring spout on said neck, said mounting means defining an upper radially inwardly projecting shoulder overlying said upper edge of the neck, means having a first portion on the neck spaced below said upper edge, and a second portion on said annular mounting means for interlocking the pouring spout removably to the neck, and a handle connected to said mounting means, the improvement comprising means defining an annular set-in-place resilient seal extending about said neck intermediate said upper edge and said first portion of the interlocking means, said seal being formed of an adhesive material preselected to be effectively positively sealingly bonded to said neck as a result of setting thereof in place on said neck, said mounting means being removably installed about the set annular seal, said seal being maintained in both radially and axially compressed sealed engagement therewith and said shoulder being spaced above said upper edge of said neck by said means for interlocking the pouring spout to the neck.

2. The decanter structure of claim 1 wherein said mounting means includes an annular downwardly facing, radially inwardly projecting shoulder engaging said seal in the installed relationship thereof to effect said maintained axial compression of the seal.

3. The decanter structure of claim 1 wherein said mounting means defines a stepped bore having an upper portion and a lower portion, said upper portion having a smaller diameter than that of said lower portion to define an annular shoulder therebetween, said seal having a first, lower portion compressed radially in said lower portion of the mounting means with a first compressive sealing force and a second, upper portion compressed radially in said upper portion of the mounting means with a second higher compressive sealing force.

4. The decanter structure of claim 1 wherein said mounting means defines a stepped bore having an upper portion and a lower portion, said upper portion having a smaller diameter than that of said lower portion to define an annular shoulder therebetween, said seal having a first, lower portion compressed radially in said lower portion of the mounting means with a first compressive sealing force and a second, upper portion compressed radially in said upper portion of the mounting means with a second higher compressive sealing force, said mounting means further defining an uppermost inturned shoulder for effectively positively limiting the downward movement of the mounting means against said seal.

5. The decanter structure of claim 1 wherein said shoulder comprises a radially inwardly projecting annular shoulder.

6. The decanter structure of claim 1 wherein the outer surface of the undeformed seal is substantially semicircular in cross section.

7. The decanter structure of claim 1 wherein said seal is formed of RTV silicone adhesive.

* * * * *